US009212322B2

(12) United States Patent
Gillis

(10) Patent No.: US 9,212,322 B2
(45) Date of Patent: Dec. 15, 2015

(54) SELECTIVE SEPARATION OF HEAVY COKER GAS OIL

(71) Applicant: Foster Wheeler USA Corporation, Houston, TX (US)

(72) Inventor: Daniel B. Gillis, Houston, TX (US)

(73) Assignee: Foster Wheeler USA Corporation, Houston, TX (US)

( * ) Notice: Subject to any disclaimer, the term of this patent is extended or adjusted under 35 U.S.C. 154(b) by 217 days.

(21) Appl. No.: 13/834,588

(22) Filed: Mar. 15, 2013

(65) Prior Publication Data

US 2013/0240410 A1 Sep. 19, 2013

Related U.S. Application Data

(60) Provisional application No. 61/612,860, filed on Mar. 19, 2012.

(51) Int. Cl.

| | |
|---|---|
| ***C10G 9/14*** | (2006.01) |
| ***C10G 21/00*** | (2006.01) |
| ***C10G 67/04*** | (2006.01) |
| *C10G 9/02* | (2006.01) |
| *C10C 3/00* | (2006.01) |
| *C10C 3/18* | (2006.01) |

(52) U.S. Cl.

CPC ..... *C10G 21/003* (2013.01); *C10G 67/049* (2013.01)

(58) Field of Classification Search

CPC ..... C10G 9/02; C10G 9/14; C10C 3/00; C10C 3/08

USPC ..... 208/131–132, 309

See application file for complete search history.

(56) References Cited

U.S. PATENT DOCUMENTS

| | | | | |
|---|---|---|---|---|
| 4,200,519 | A | 4/1980 | Kwant et al. | |
| 4,435,275 | A | 3/1984 | Derr et al. | |
| 5,645,712 | A | 7/1997 | Roth | |
| 5,824,194 | A | 10/1998 | Kruse | |
| 2008/0116109 | A1 * | 5/2008 | McCoy et al. | 208/39 |
| 2010/0329936 | A1 | 12/2010 | Van Wees et al. | |

FOREIGN PATENT DOCUMENTS

| | | | | |
|---|---|---|---|---|
| WO | WO-9725390 A1 | | 7/1997 | |
| WO | WO 9836036 | * | 8/1998 | C10G 9/14 |

OTHER PUBLICATIONS

Maples, R.E. (2000). Petroleium Refinery Process Economics, 2nd ed., PennWell, 474 pgs.*

* cited by examiner

*Primary Examiner* — Brian McCaig
(74) *Attorney, Agent, or Firm* — Winstead PC

(57) ABSTRACT

Embodiments of the invention are directed to the improvement of the design of coker systems and processes in order to improve the yields and separation of heavy coker gas oils derived therefrom.

16 Claims, 11 Drawing Sheets

| HCGO END POINT, °C | BASE | + 21 | + 41 | + 54 |
|---|---|---|---|---|
| INCREMENTAL EEC, $M | 0 | 6.5 | 12.5 | - |

SELECTIVE SEPARATION OF HEAVY COKER GAS OIL

CROSS-REFERENCES TO RELATED APPLICATIONS

This application claims the benefit under 35 U.S.C. §119 (e) of U.S. Provisional Patent Application Ser. No. 61/612,860 filed Mar. 19, 2012, which is incorporated herein by reference in its entirety as if fully set forth herein.

BACKGROUND OF THE INVENTION

Delayed Coking is a well proven and commercialized process for converting residues into lower molecular weight petroleum fractions suitable for treating or further conversion in other refining processes and production of a solid residue byproduct (coke) that contains the majority of the contaminants in residues that are detrimental for processing in other refinery processes. Some of the contaminants in residues do end up in the delayed coking lighter products especially the Heavy Coker Gas Oil (HCGO).

Delayed coking processes have been used in the prior art to thermally decompose heavy liquid hydrocarbons into gases, liquid streams of various boiling ranges, and coke. The delayed coking process involves heating hydrocarbon liquids in a coking furnace and transferring the heated liquids to a coking drum where the liquids decompose into coke and volatile components.

In order to practically use the delayed coking process, a coker fractionation system is needed along with the coking furnace and coking drums. The coker fractionating system separates the volatile components generated in the coking drum into various hydrocarbon streams.

In the basic delayed coking process, a liquid hydrocarbon feedstock is initially added to the bottom of a coker fractionator column where it mixes with the column bottoms liquid which is referred to as "natural recycle material." This mixture of feedstock and natural recycle material is taken from the fractionator column bottom and then pumped through furnace tubes of the coking furnace where it is heated to about 1000° F. The heated stream is then transferred to the coking drum where the temperature and pressure are maintained at coking conditions such that the stream decomposes into coke and volatile components. The volatile components, called "coke drum vapors", are then returned to the coker fractionating system for separation into various components. When the coke drum becomes full of solid coke, the heated stream from the coker furnace is diverted to another coke drum and the full coke drum is cooled and emptied.

The coker fractionating system used in the delayed coking process generally includes a fractionator column which includes a reservoir for the heavy recycle material and feedstock mixture at the bottom of the column. Above the reservoir is a flash zone, an open area within the column, into which the coke drum vapors are introduced. The heaviest components of the coke drum vapors are condensed in the flash zone and the remaining vapors are fractionated by multiple trays above the flash zone. At the top of the coker fractionator column is a vapor reflux system in which at least a portion of the overhead vapor stream being discharged from the column is condensed and returned to the top fractionator tray. The remainder of the condensed overhead vapor stream is withdrawn as an unstabilized naphtha product.

Traditionally, two liquid streams are removed from the coker fractionating system at different points in the fractionating column. A light coker gas oil stream is removed from a tray near the top of the fractionator to provide one end product of the system. This is known as the light coker gas oil draw. The second stream is a heavy coker gas oil stream removed near the bottom fractionation tray to provide a second end product of the system. This is known as the heavy coker gas oil draw.

Generally, a portion of this second stream is returned to the column as part of a pump-around system. Pump-around systems are generally used to recover thermal energy from the fractionator column and include a pump and a heat exchanger to provide heat to another process stream or to generate steam. When the pump-around system is connected to the heavy coker gas oil draw, thermal energy is removed from the lower part of the fractionation system. The removal of heat at this point in the column reduces fractionation efficiency and results in a heavy coker gas oil product stream which contains light end hydrocarbons. These light end hydrocarbons are removed by further processing to meet the heavy coker gas oil product's downstream processing specification requirements. Typically, this is done by providing an additional steam stripping system which includes a stripping column, multiple product pumps, and a heat exchanger for recovering heat from the stripping column.

Maximizing liquid yields in delayed coking is usually desirable for most applications, especially when making fuel grade coke where the coke's value is relatively low compared to the distillable products from the coking process. When maximizing the liquid yields, typically the HCGO yield and its end boiling point are maximized within the capabilities of the delayed coking process. Accordingly, when maximizing the HCGO yield and end boiling point, the HCGO's contaminants such as Sulfur, Nitrogen, multi-ring aromatics, and asphaltenes increase significantly (see FIG. 1 and FIG. 2). FIG. 1 shows a hydrocracking process using a combined feed. The feed rate to the hydrocracking process increased with HCGO end point and this raises conversion to valuable distillate range products. The maximum HCGO end-point is determined by contaminant levels in the blended feed, the quantity of $C_7$ insolubles, which is critical and the need to assess the impact on the hydrocracking unit. FIG. 2 shows the properties of HCGO as the end-point increases. At a higher HCGO end-point, the amount of metals, Conradson carbon and asphaltenes increase rapidly, the hydrocracking unit capacity and cost increases, and the delayed coking unit cost decreases due to the lower recycle. These contaminants, especially multi-ring aromatics and asphaltenes, can pose a problem in the downstream vacuum gas oil conversion units, such as hydrocrackers. The delayed coker operation may then be constrained by limitations imposed by downstream processing units because of the negative impacts of the highest end point components of HCGO on downstream vacuum gas oil (VGO) conversion processes, especially hydrocracking's catalyst life. Table 1 shows the impact of increasing the HCGO end point on hydrocracking unit operation. Contaminant levels at the highest HCGO end point cause excessive catalyst deactivation.

TABLE 1

| HCGO End Point, ° C. | Base | +21 | +41 | +54 |
|---|---|---|---|---|
| Stage 1 Liquid Feedrate | Base | +4% | +7% | +8% |
| Stage 2 Liquid Feedrate | Base | +4% | +7% | +8% |
| Pressure | Base | Base | Base | Base |
| Make-up Gas Rate | Base | +7% | +13% | +17% |
| Recycle Gas Rate | Base | +4% | +7% | +8% |

TABLE 1-continued

| HCGO End Point, ° C. | Base | +21 | +41 | +54 |
|---|---|---|---|---|
| Catalyst Volume | | | | |
| R-1 (First Stage) | Base | +6% | +12% | +25% |
| R-2 (First Stage) | Base | +8% | +14% | +23% |
| R-3 (Second Stage) | Base | +4% | +7% | +8% |

If these contaminants are removed, the downstream processing costs will be significantly reduced and the liquid yields from the combined delayed coker and the downstream VGO Hydrocracking or FCC processes will be maximized. Maximizing the end boiling point of HCGO directionally will maximize the upgrading margins for most transportation fuels applications. An example of the benefits is shown in FIG. 3. As shown in FIG. 3, incrementally raising the HCGO end point to the highest practicable level, increases the product value of the hydrocracked products by almost 100 million dollars per year. In return for an incremental investment that is relatively low, coker cost reduction partially offsets hydrocracking unit cost increases. Thus, there is a strong economic incentive to maximize the HCGO end point.

Thus, it would be advantageous to have a delayed coker design that can maximize its HCGO yield while producing a HCGO suitable for VGO Hydrocracking, which would have both liquid yield and economic benefits.

Typical delayed coking units have configurations such as shown in FIG. 4. Feed typically enters the lower zone of the fractionator where it is mixed with any recycle streams such as HCGO that is condensed from the cooling of the coke drum vapors in the fractionator. This also provides a surge capacity resulting in a steady feed rate to the coke drums and with consistent feed quality. The fractionator bottom stream is then heated and sent to the coke drums where majority of the thermal cracking reactions occur.

In an alternative form of the delayed coker, typically referred to a zero recycle coking, feed is sent directly to the process heater and a heavier HCGO product (HHCGO) is drawn from the bottom of the fractionator (FIG. 5).

Table 2 shows the typical yields when processing a medium sour vacuum residue. Zero recycle coking typically increases HCGO liquid yield by 3-4 volume %. Coke is reduced by 1-2 weight %.

TABLE 2

| | Low Recycle | Zero Recycle | Incremental |
|---|---|---|---|
| Pressure, psig | 15 | 15 | |
| Recycle ratio | 1.05 | 1.00 | −0.05 |
| DRYGAS, wt % | 3.80 | 3.79 | −0.01 |
| LPG, vol % | 6.77 | 6.58 | −0.19 |
| Naphtha, vol % | 13.86 | 12.91 | −0.95 |
| LCGO, vol % | 25.86 | 24.11 | −1.75 |
| HCGO, vol % | 34.38 | 37.56 | 3.18 |
| $C_{5+}$ liquids, vol % | 74.01 | 74.58 | 0.57 |
| Coke, wt % | 27.67 | 26.53 | −1.14 |

Table 2 shows the properties of HCGO with conventional low recycle coking and zero recycle coking and how the HCGO properties deteriorate as the HCGO end point is increased and maximized in the case of zero recycle coking. The deterioration in properties results in most delayed coking process designs for transportation fuel applications limiting the end point of the HCGO to about 1065° F. which is obtainable with low recycle and pressure coking, particularly when HCGO is sent to a VGO hydrocracking process.

SUMMARY OF THE INVENTION

An embodiment of the invention is directed to a method of separating coker drum vapors, comprising: introducing coker drum vapors into a flash zone of a coker fractionating column; removing a heavy coker gas oil stream from the coker fractionating column; processing the heavy coker gas oil stream to remove contaminants; and producing a heavy coker gas oil stream that is suitable for hydrocracking. In certain embodiments, the heavy coker gas oil is processed in a solvent deasphalting unit that is integrated with the coker fractionating column.

DETAILED DESCRIPTION OF EXEMPLARY EMBODIMENTS

Figure 6:
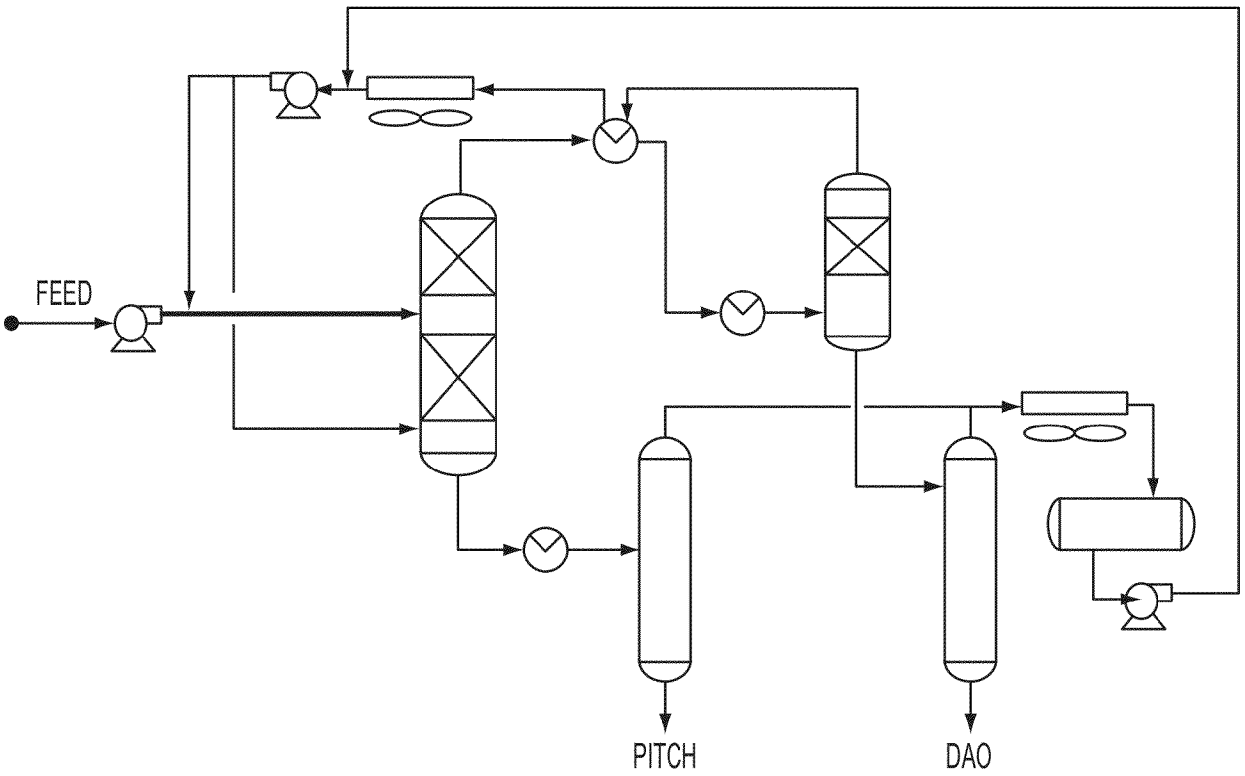
FIG. 6 shows the configuration of a solvent deasphalting unit.
Figure 7:
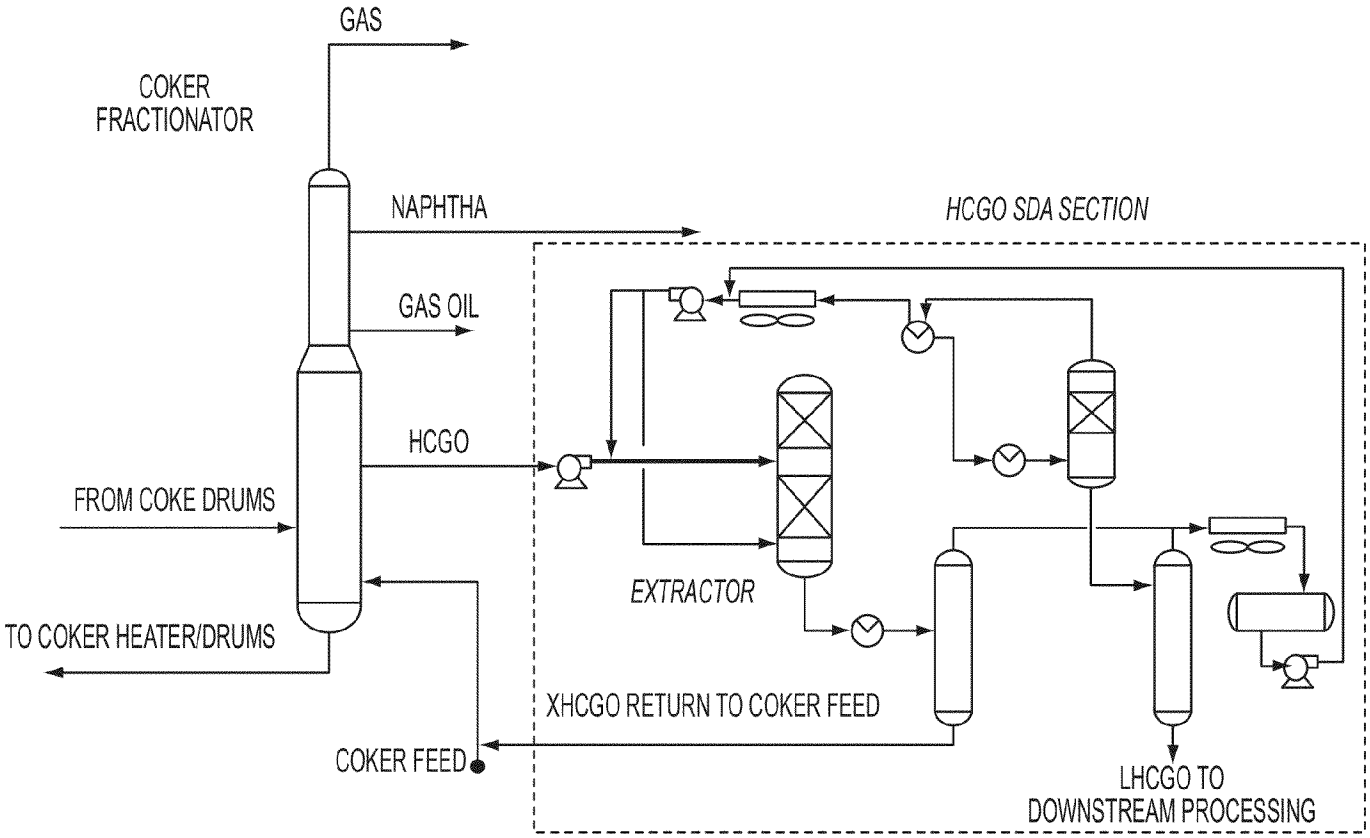
FIG. 7 shows the integration of the HCGO separation process with a SDA process dedicated for HCGO selective separation in accordance with an embodiment of the invention.

In a first embodiment of the invention, the HCGO product is sent to a Solvent Deasphalting Unit (SDA) dedicated to separating HCGO. FIG. 6 shows a typical SDA flow scheme. FIG. 7 shows the integration of HCGO with a SDA process dedicated for HCGO selective separation. The contaminants in the HCGO are rejected in an extra heavy coker gas oil (XHCGO) stream that is recycled back to the delayed coking fractionator's feed. This results in eventually rejecting these contaminants in the delayed coking unit's residue byproduct coke. The recovered higher quality lighter heavy coker gas oil (LHCGO) is sent to the downstream VGO conversion unit. Table 3 shows the comparison of the properties of HCGO in a ultra-low recycle operation relative to a true-zero recycle operation when processing a medium sour vacuum residue. Table 4 shows the VGO conversion unit feeds in a systems using zero recycle coking coupled with HHCGO selective separation.

TABLE 3

| | Low Recycle | Zero Recycle |
|---|---|---|
| Gravity, API % | 13.7 | 12.5 |
| Density | 0.9746 | 0.9829 |
| Sulfur, wt % | 3.33 | 3.30 |
| Nitrogen, wppm | 2035 | 2015 |
| CCR, wt % | 1.68 | 2.8 |
| C7 insolubles, wppm | 1013 | 3530 |
| Ni + V, wppm | 2.0 | 4.0 |
| Distillation, ° F. | | |
| 10% | 693 | 698 |
| 50% | 840 | 869 |
| EP | 1072 | 1141 |
| Watson K | 11.20 | 11.19 |

TABLE 4

| | Low Recycle | Zero Recycle | Zero Recycle with HHCGO selective separation |
|---|---|---|---|
| Gravity, API % | 13.7 | 12.5 | 14.9 |
| Density | 0.9746 | 0.9829 | 0.9664 |
| Sulfur, wt % | 3.33 | 3.30 | 3.22 |
| Nitrogen, wppm | 2035 | 2015 | 1700 |
| CCR, wt % | 1.68 | 2.12 | 0.97 |
| C7 insolubles, wppm | 1013 | 2673 | 220 |
| Ni + V, wppm | 2.0 | 3.1 | 0.69 |
| Watson K | 11.20 | 11.19 | 11.28 |

Figure 8:
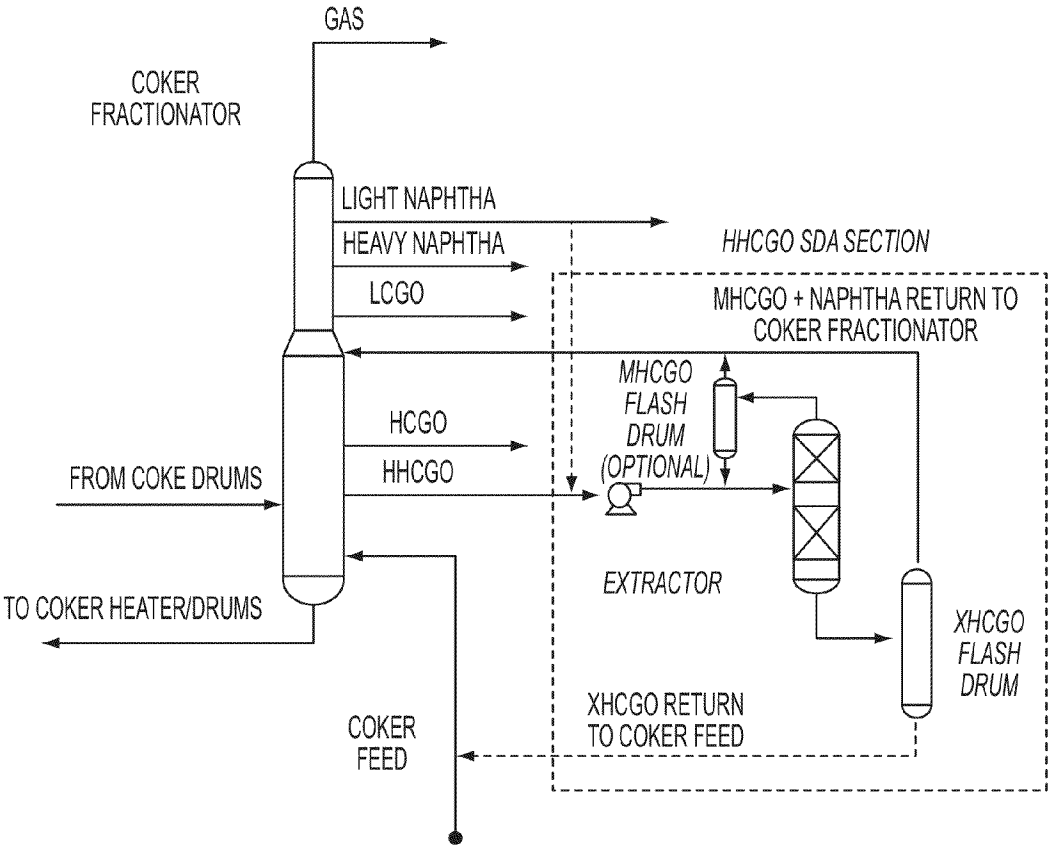
FIG. 8 shows the separation of HHCGO in accordance with an embodiment of the invention.

In a further embodiment of the invention as shown in FIG. 8, a smaller but heavier HCGO (HHCGO) stream which contains most of the HCGO contaminants; such as multi-ring aromatics and asphaltenes, is drawn from the fractionator, combined with part of the delayed coking unit's light naphtha product, and sent to a SDA extractor. This light naphtha solvent will extract most of the HCGO components into a DAO/solvent phase and reject the heaviest multi-ring aromatics and all of the asphaltenes into a pitch phase. The DAO phase from the extractor is sent back into the HCGO reflux section of the fractionator: or first to a flash tower to recover the bulk of the light naphtha solvent. The pitch phase is flashed with the overhead naphtha stream being sent back to the fractionator with the DAO phase and the HHCGO stream sent to the fractionator's feed section. Because no other heat exchange or separation vessels are required, the cost to extract these multi-ring aromatics is relatively low compared to a dedicated SDA unit.

Figure 9:
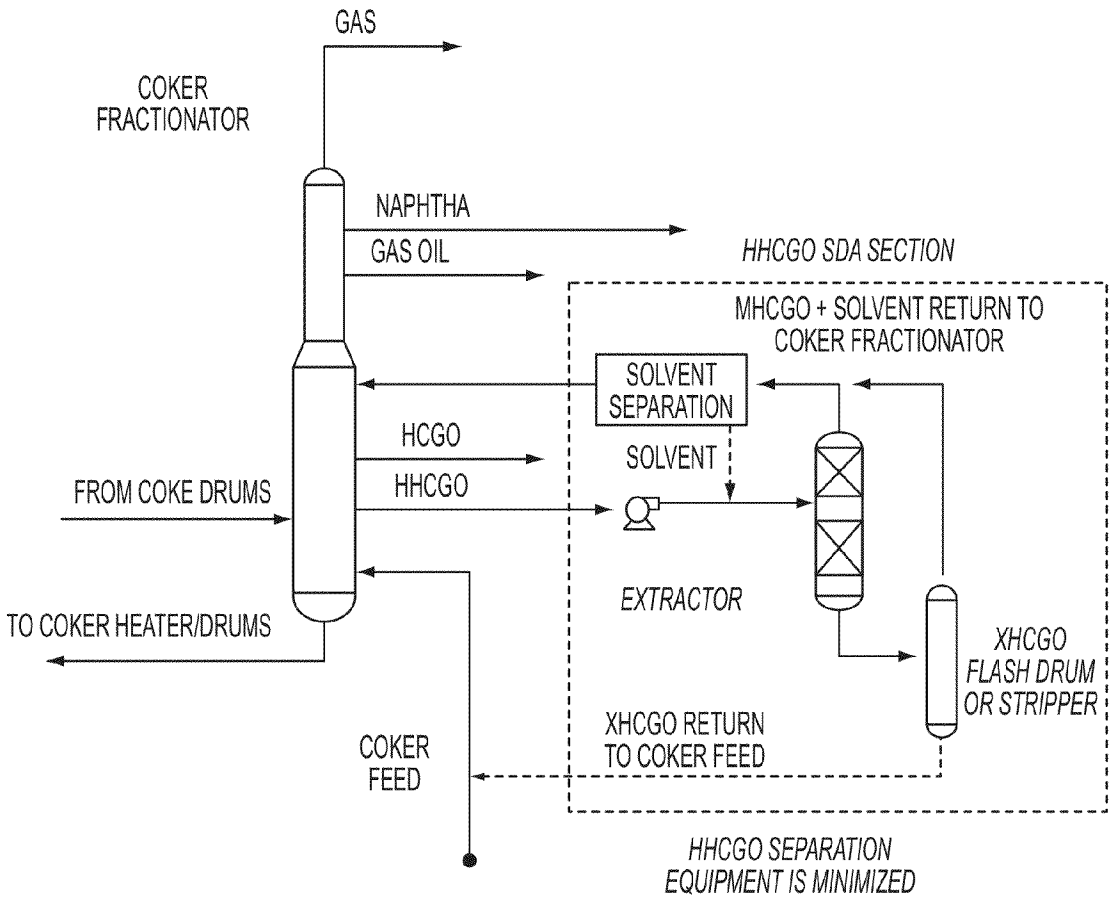
FIG. 9 shows the combination of a delayed coking process with the HHCGO separation process in accordance with an embodiment of the invention.

In another embodiment of the invention as shown in FIG. 9, the HHCGO is mixed with a solvent selected to selectively reject medium multi-ring aromatics and other contaminants. Additional solvent recovery equipment would be required in this embodiment. This version would be used for producing a HCGO suitable for a downstream VGO hydrocracking which has limited capabilities to process difficult feedstocks.

Figure 1:
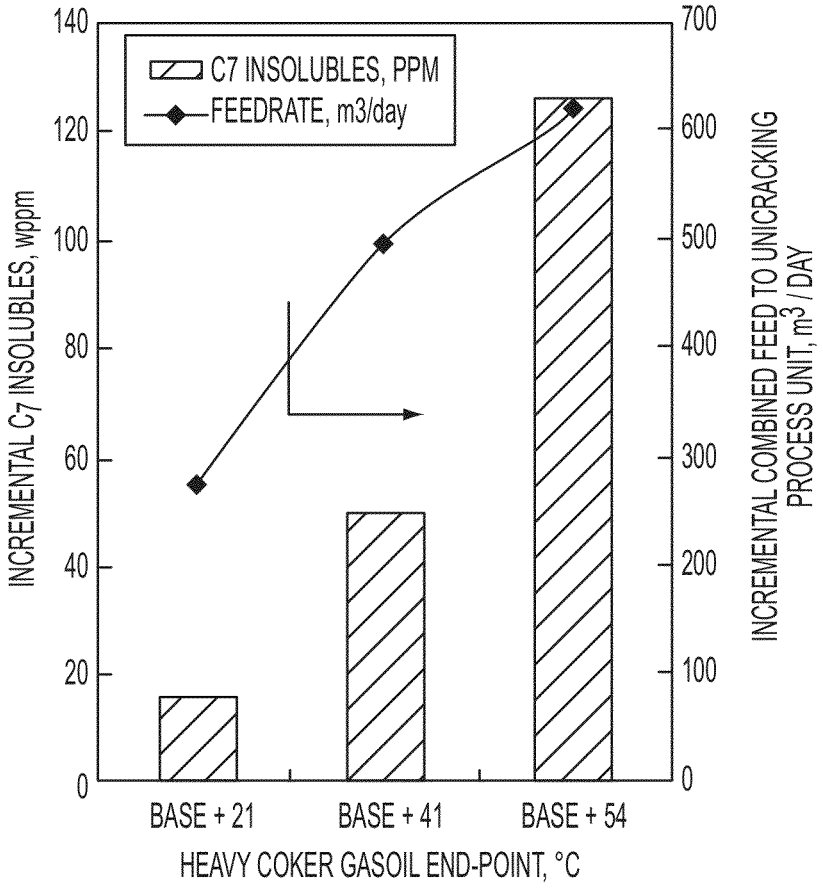
FIG. 1 shows the yield obtained from a hydrocracking process using a combined feed.
Figure 2:
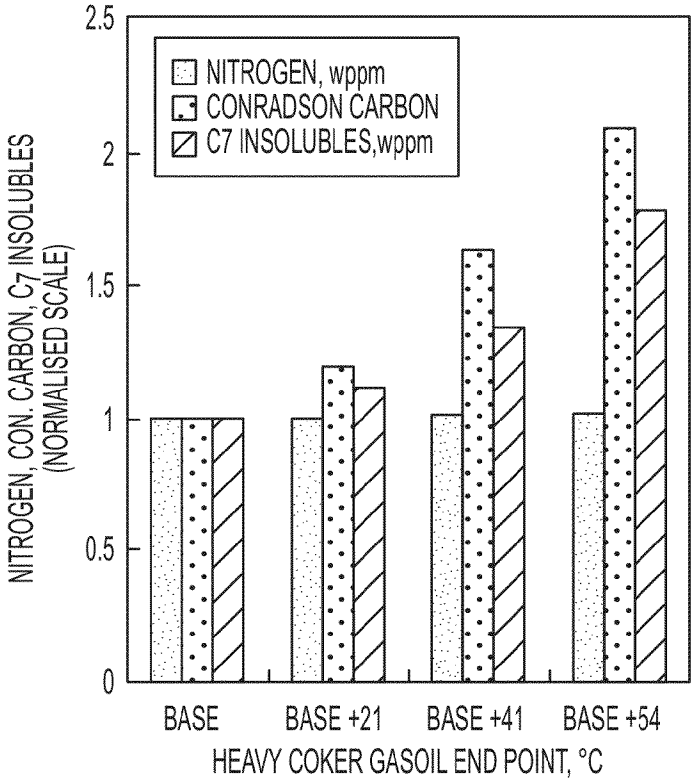
FIG. 2 shows the properties of HCGO as the end-point increases.
Figure 2:
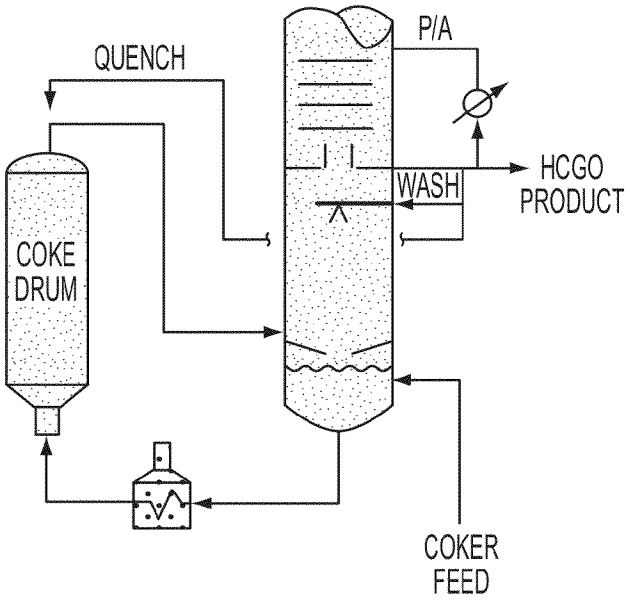
Figure 3:
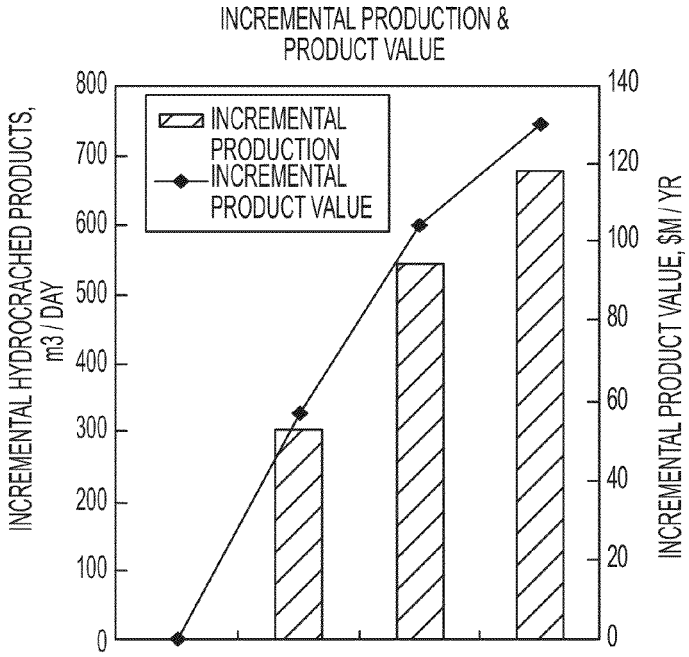
FIG. 3 shows the benefits of maximizing the end boiling point of HCGO directionally.
Figure 4:
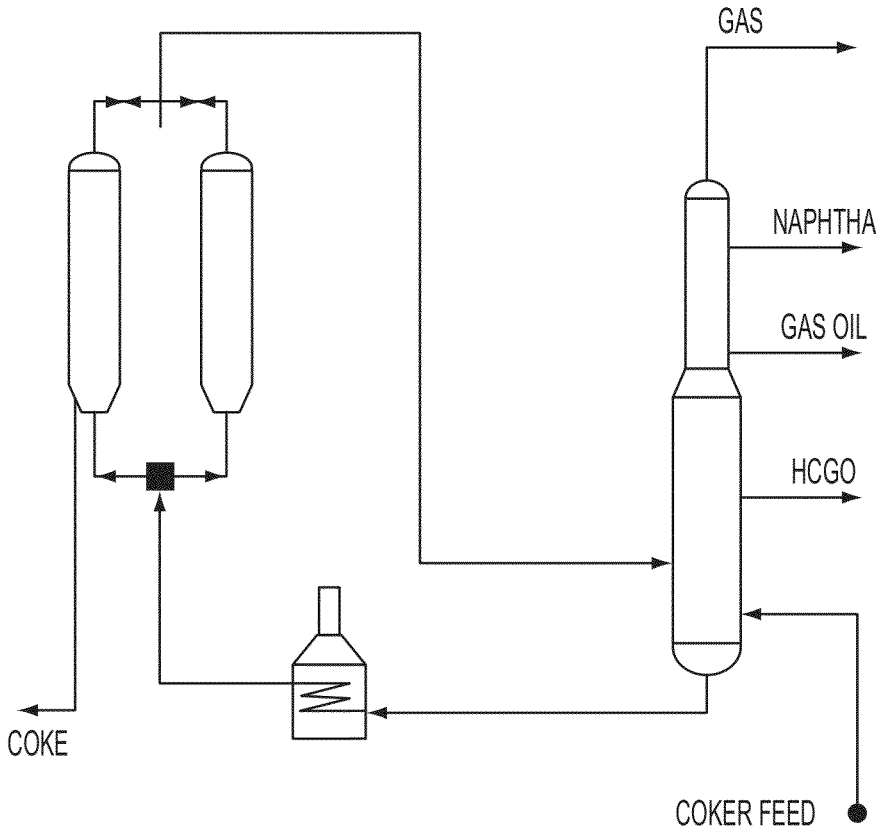
FIG. 4 shows the configuration of a typical delayed coke unit.
Figure 5:
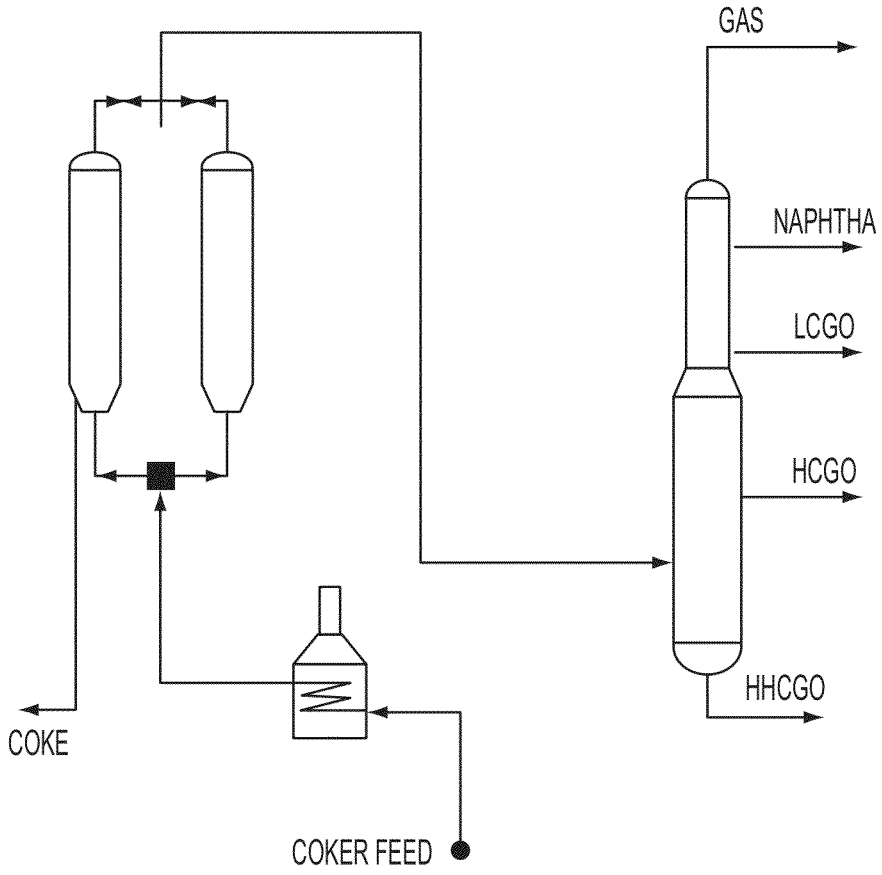
FIG. 5 shows the configuration of a zero recycle coking unit.
Figure 10:
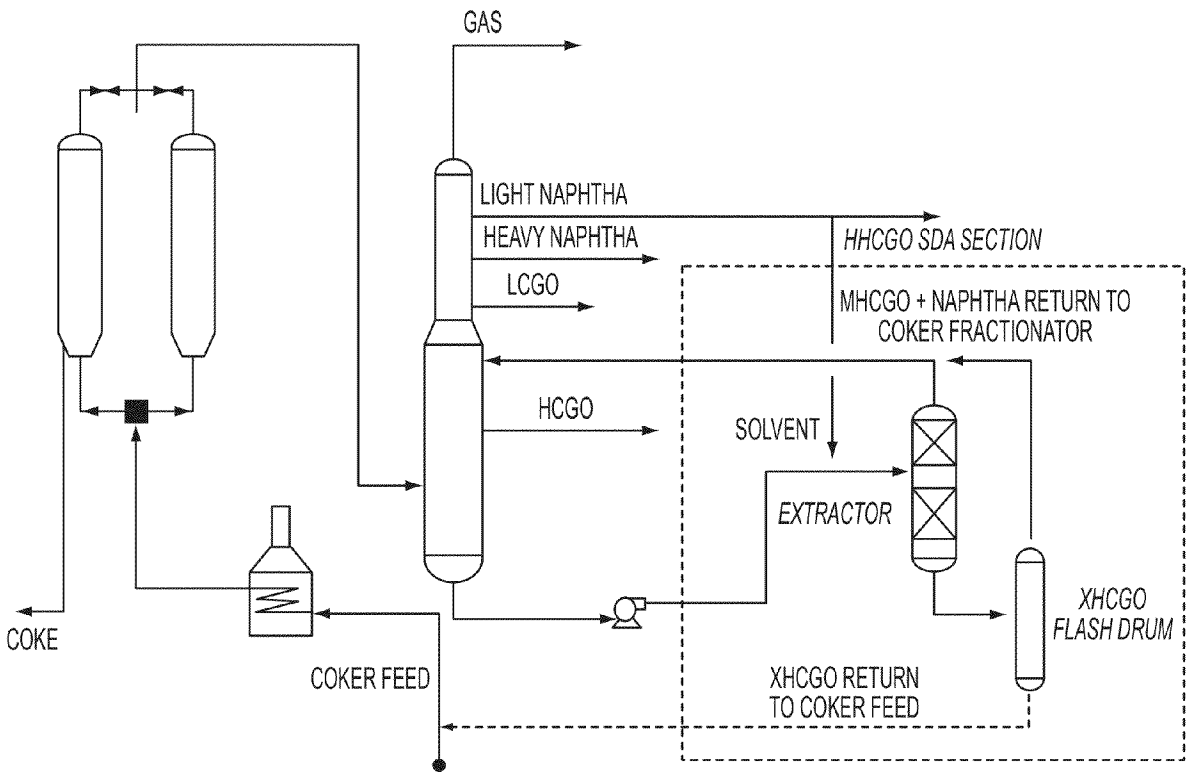
FIG. 10 shows the combination of a zero recycle coking process with the HCGO separation process in accordance with an embodiment of the invention.
Figure 11:
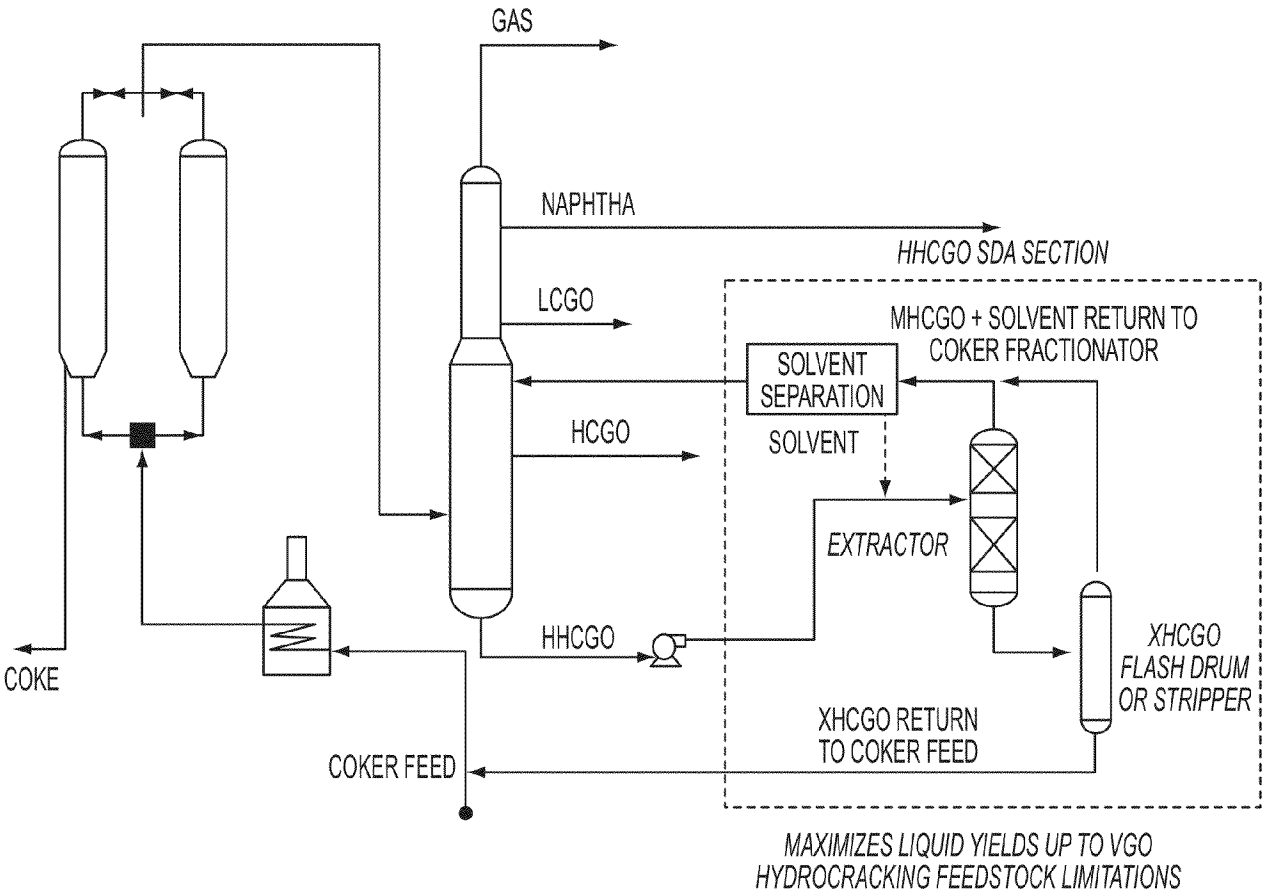
FIG. 11 shows the combination of a zero recycle coking process with the HHCGO separation process in accordance with an embodiment of the invention.

In yet another embodiment of the invention for zero recycle coking applications, the HHCGO stream is drawn from the bottom of the delayed coking unit's fractionator. The HHCGO stream is then separated in the SDA unit such as in the previous embodiments. FIG. 10 shows the configuration for rejection of the asphaltenes and heaviest multi-ring aromatics with coker light naphtha. This embodiment maximizes delayed coking yields while ensuring the recovered HHCGO properties are suitable for VGO hydrocracking. FIG. 11 shows the configuration for a zero recycle coking process combined with the HHCGO separation process The benefits of removing contaminants in HCGO can be seen in FIG. 3 as incremental liquid yields are produced as the HCGO is maximized. The SDA also eliminates the need for incremental capital and operating costs in the VGO Hydrocracker when maximizing the HCGO end point. Table 3 shows the differences in feeds and properties for both low pressure/recycle coking and zero recycle coking and HHCGO SDA selective separation. Table 5 shows the combined yields of delayed coking and VGO Hydrocracking for these two options.

TABLE 5

| | Low Recycle Coking | Zero Recycle Coking + HHCGO Selective Separation |
|---|---|---|
| VR Feed, wt % | −100.00 | −100.00 |
| Hydrogen, wt % | −0.90 | −0.98 |
| Coke, wt % | 27.62 | 26.72 |
| Fuel Gas, wt % | 6.28 | 6.35 |
| Butanes, vol % | 3.89 | 3.85 |
| Naphtha, vol % | 17.86 | 17.49 |
| Distillate, vol % | 60.28 | 61.40 |
| Unconverted Oil, vol % | 0.55 | 0.61 |
| Total C5+, vol % | 78.69 | 79.50 |
| Inc C5+, vol % | | 0.81 |
| Margin Increase, $/bbl VR | | 0.50 |

The coke production is decreased by 0.9 wt %, overall liquid yields increased by 0.81 vol %, and Distillate yields increased by 1.1 vol %. For a typical Vacuum Residue Delayed Coker the value of this coking option over conventional low recycle coking is $0.50/bbl Vacuum Residue Feed.

The process of the invention has been described and explained with reference to the schematic process drawings. Additional variations and modifications may be apparent to those of ordinary skill in the art based on the above description and the scope of the invention is to be determined by the claims that follow.

The invention claimed is:

1. A method of separating coker drum vapors, comprising:

introducing coker drum vapors into a flash zone of a coker fractionating column;

removing a heavy coker gas oil stream from the coker fractionating column;

processing the heavy coker gas oil stream with an extactor to remove contaminants; and wherein the processing the heavy coker gas oil stream creates an output feed stream, an amount of which is recycled to the coker fractionating column, the output feed stream comprising:

an extra heavy coker gas oil stream containing contaminants rejected from the heavy coker gas oil stream that is recycled back to a feed section of the coker fractionating column; and a lighter heavy coker gas oil stream that is sent downstream to a vacuum gas oil conversion unit.

2. A method of separating coker drum vapors, comprising:

introducing coker drum vapors into a flash zone of a coker fractionating column;

removing a heavier heavy coker gas oil stream from the coker fractionating column, the heavier heavy coker gas oil stream comprising contaminants from a heavy coker gas oil stream;

adding a light naphtha solvent to the heavier heavy coker gas oil stream;

processing the heavier heavy coker gas oil stream with an extractor to remove contaminants; and wherein the processing the heavier heavy coker gas oil stream creates an output feed stream, an amount of which is recycled to the coker fractionating column, the output feed stream comprising:

an extra heavy coker gas oil stream containing contaminants rejected from the heavier heavy coker gas oil stream that is recycled back to the coker fractionating column; and a medium heavy coker gas oil stream that is recycled back to the coker fractionating column.

3. The method of claim 2, further comprising:

introducing the medium heavy coker gas oil stream into a flash drum to separate a second heavier heavy coker gas oil stream from the medium heavy coker gas oil stream prior to recycling the medium heavy coker gas oil stream back to the coker fractionating column; and adding the second heavier heavy coker gas oil stream to the heavier heavy coker gas oil stream prior to the processing the heavier heavy coker gas oil stream.

4. The method of claim 2, further comprising introducing the extra heavy coker gas oil stream to a flash drum to separate a second medium heavy coker gas oil stream from the extra heavy coker gas oil stream.

5. The method of claim 4, further comprising recycling the second medium heavy coker gas oil stream to the coker fractionating column.

6. A method of separating coker drum vapors, comprising:

introducing coker drum vapors into a flash zone of a coker fractionating column;

removing a heavier heavy coker gas oil stream from the coker fractionating column;

mixing the heavier heavy coker gas oil stream with a solvent selected to selectively reject medium multi-ring aromatics and other contaminants;

processing the heavier heavy coker gas oil stream with an extractor to remove contaminants; and wherein the processing the heavier heavy coker gas oil stream creates an output feed stream, an amount of which is recycled to the coker fractionating column, the output feed stream comprising:

an extra heavy coker gas oil stream containing contaminants rejected from the heavier heavy coker gas oil stream that is recycled back to the coker fractionating column; and a medium heavy coker gas oil stream that is recycled back to the coker fractionating column.

7. The method of claim 6, further comprising introducing the medium heavy coker gas oil stream into a solvent separation unit to recover at least a portion of the solvent prior to recycling the medium heavy coker gas oil stream back to the coker fractionating column.

8. The method of claim 6, further comprising introducing the extra heavy coker gas oil stream to a flash drum to separate a second medium heavy coker gas oil stream from the extra heavy coker gas oil stream.

9. The method of claim 8, further comprising introducing the second medium heavy coker gas oil stream to a solvent separation unit to recover at least a portion of the solvent.

10. A method of separating coker drum vapors, comprising:

introducing coker drum vapors into a flash zone of a coker fractionating column;

removing a bottoms stream from the coker fractionating column, the bottoms stream comprising asphaltenes and heaviest multi-ring aromatics;

adding a light naphtha solvent to the bottoms stream;

processing the bottoms stream with an extractor to remove contaminants; and wherein the processing the bottoms stream creates an output feed stream, an amount of which is recycled to the coker fractionating column, the output feed stream comprising:

an extra heavy coker gas oil stream containing contaminants rejected from the bottoms stream that is recycled back to a furnace via a coker feed stream; and a medium heavy coker gas oil stream that is recycled back to the coker fractionating column.

11. The method of claim 10, further comprising introducing the extra heavy coker gas oil stream to a flash drum to separate the extra heavy coker gas oil stream into a second medium heavy coker gas oil stream and an extra heavy coker gas oil stream.

12. The method of claim 11, further comprising recycling the second medium heavy coker gas oil stream to the coker fractionating column.

13. A method of separating coker drum vapors, comprising:

introducing coker drum vapors into a flash zone of a coker fractionating column;

removing a heavier heavy coker gas oil stream from the coker fractionating column;

mixing the heavier heavy coker gas oil stream with a solvent selected to selectively reject medium multi-ring aromatics and other contaminants;

processing the heavier heavy coker gas oil stream to remove contaminants; and wherein the processing the heavier heavy coker gas oil stream creates an output feed stream, an amount of which is recycled to the coker fractionating column, the output feed stream comprising:

an extra heavy coker gas oil stream containing contaminants rejected from the heavier heavy coker gas oil stream that is recycled back to a furnace via a coker feed; and a medium heavy coker gas oil stream that is recycled back to the coker fractionating column.

14. The method of claim 13, further comprising introducing the medium heavy coker gas oil stream into a solvent separation unit to recover at least a portion of the solvent prior to recycling the medium heavy coker gas oil stream back to the coker fractionating column.

15. The method of claim 13, further comprising introducing the extra heavy coker gas oil stream to a flash drum to separate a second medium heavy coker gas oil stream from the extra heavy coker gas oil stream.

16. The method of claim 15, further comprising introducing the second medium heavy coker gas oil stream to a solvent separation unit to recover at least a portion of the solvent prior to recycling the second medium heavy coker gas oil stream back to the coker fractionating column.

* * * * *